United States Patent [19]

Smilgys

[11] 4,142,672

[45] Mar. 6, 1979

[54] COUNTER WHEEL ASSEMBLY WITH IMPROVED RESET CONTROL MECHANISM

[75] Inventor: Bruno S. Smilgys, Hartford, Conn.

[73] Assignee: Veeder Industries Inc., Hartford, Conn.

[21] Appl. No.: 857,241

[22] Filed: Dec. 5, 1977

[51] Int. Cl.[2] ..... G06C 15/42

[52] U.S. Cl. ..... 235/144 D; 235/131 FD; 235/144 PN; 235/144 SM

[58] Field of Search ..... 235/144 PN, 144 D, 144 SM, 235/144 SP, 144 M, 131 FD

[56] References Cited

U.S. PATENT DOCUMENTS

| | | | |
|---|---|---|---|
| 2,932,448 | 4/1960 | Bliss | 235/144 SM |
| 3,223,316 | 12/1965 | Coulter et al. | 235/1 R |
| 3,920,964 | 11/1975 | Young | 235/144 SM |

*Primary Examiner*—Stephen J. Tomsky

*Attorney, Agent, or Firm*—Prutzman, Kalb, Chilton & Alix

[57] ABSTRACT

A resettable register counter wheel assembly with a modified reset gear control mechanism having a modified reset gear pawl pivotal about an axis transverse to the wheel axis for selectively engaging and disengaging a reset gear and a reset control pawl pivotally mounted on the wheel about an axis parallel to and offset from the wheel axis and extending between the reset gear pawl and wheel shaft for pivoting the reset gear pawl outwardly with the shaft and for accurately locking the wheel to the shaft in its fully reset position.

4 Claims, 3 Drawing Figures

COUNTER WHEEL ASSEMBLY WITH IMPROVED RESET CONTROL MECHANISM

BRIEF SUMMARY OF THE INVENTION

The present invention relates generally to resettable registers of the type employed in fuel dispensing apparatus for registering the volume and/or cost amount of fuel dispensed, as for example as shown and described in U.S. Pat. No. 2,932,448 of H. N. Bliss dated Apr. 12, 1960 and entitled "Resetting Mechanism for Counters" and relates more particularly to a resettable counter wheel assembly of the type disclosed in U.S. Pat. No. 2,932,448 and also in U.S. Pat. No. 3,223,316 of L. E. Coulter et al., dated Dec. 14, 1965 and entitled "Counter Wheel Assembly" and comprising an indicia wheel, an independently rotatable reset gear, and a reset control mechanism for selectively engaging the reset gear to the indicia wheel (by axially shifting its support shaft) for resetting the indicia wheel to a predetermined reset or zero position and disengaging the reset gear and locking the indicia wheel in its reset position to its support shaft.

The principal aim of the present invention is to provide in a counter wheel assembly of the type described, a new and improved reset control mechanism for selectively engaging the reset gear to the indicia wheel for resetting the indicia wheel and disengaging the reset gear and locking the indicia wheel to its support shaft exactly at its reset position.

Another aim of the present invention is to provide in a fuel pump register, a new and improved counter wheel assembly of the type described ensuring that the fuel pump register is accurately reset to zero between fuel deliveries and thereby ensuring that the fuel pump register accurately registers the amount of the subsequent fuel delivery.

A further aim of the present invention is to provide an improved counter wheel assembly of the type described having a simple and economical reset conrol mechanism for engaging the reset gear for accurately and smoothly resetting the indicia wheel and which provides for timely engagement and disengagement of the reset gear and locking the indicia wheel to its support shaft as it is rotated to its reset or zero position.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figure 1:
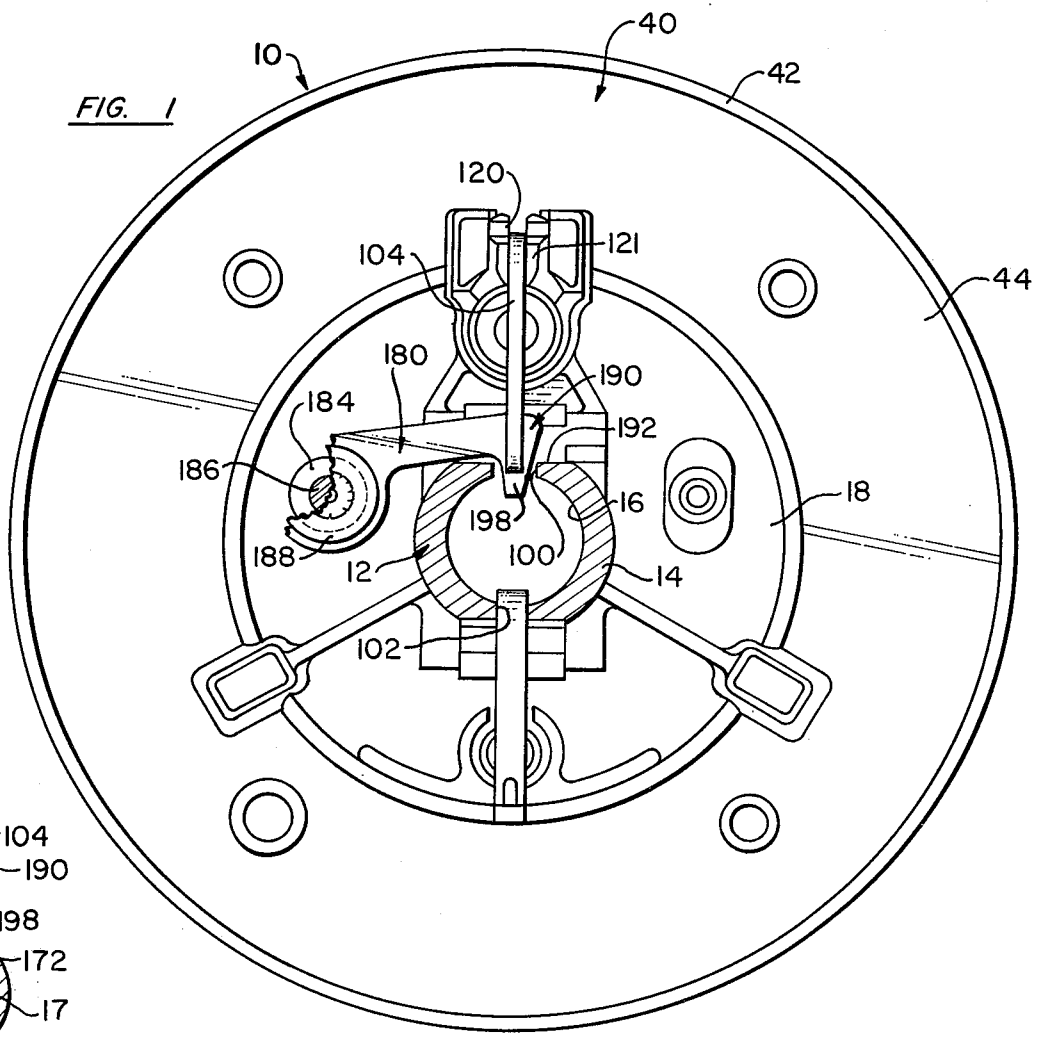
FIG. 1 is a transverse section view, partly broken away and partly in section, taken substantially along line 1—1 of FIG. 2, of a counter wheel assembly incorporating an embodiment of the present invention.
Figure 3:
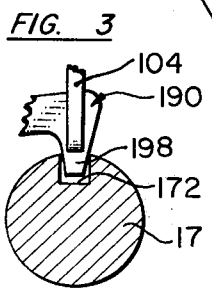
FIG. 3 is a partial transverse section view, partly broken away and partly in section, showing the wheel support shaft in a reset axial position thereof engaged by a reset control pawl of the counter wheel assembly for locking the counter wheel in its fully reset position.

Referring now to the drawing in detail, an embodiment 10 of a counter wheel assembly incorporating the present invention is constructed generally similar to the counter wheel assembly disclosed in the aforementioned U.S. Pat. Nos. 2,932,448 and 3,223,316 excepting for the modification provided by the present invention.

The counter wheel assembly comprises a cast hub 12 having a central tubular portion 14 with a bore 16 for receiving a counter wheel reset shaft 17, and an integral radial flange 18 adjacent to what will be termed for convenience the higher order axial end of the wheel assembly 10. The flange 18 has a peripheral partially cylindrical shoulder 32 for engagement by the usual mutilated transfer pinion (not shown) for holding the transfer pinion against rotation and a double tooth transfer segment 36 adapted to engage the mutilated transfer pinion to transfer a count to the next higher order wheel (not shown), the counter wheel assembly 10 of the present invention having particular utility as the right hand or lowest order wheel in fuel pump cost and volume counters of the type shown and described in the aforementioned U.S. Pat. No. 2,932,448.

An indicia bearing rim 40 of the counter wheel assembly, preferably constructed of sheet metal aluminum, includes a generally cylindrical portion 42 that is suitably embellished with appropriate indicia, conventionally the numerals 0 through 9, and an inwardly extending radial flange portion 44 that is riveted to the hub flange 18.

A reset gear 70 of the type shown in U.S. Pat. No. 2,932,448 is rotatably mounted at the higher order end of the counter wheel assembly on the wheel support shaft 17. The reset gear 70 is retained against axial outward movement by an adjacent higher order wheel (not shown) or end washer (not shown) and is retained for assembly purposes by a plurality of integral angularly spaced retaining lugs 74 of the hub flange 18. The reset gear 70 engages the end of the central tubular portion 14 of the hub 12 for retaining the reset gear 70 against inward axial movement.

A drive gear 90 (which is formed of sheet metal as shown in the case of a right hand or lowest order wheel) is rotatably mounted on the tubular portion 14 at the opposite or lower order end of the wheel and is retained thereon against outward axial movement by a radial annular shoulder or flange 99 of a retaining collar secured onto the end of the central tubular portion 14 of the hub 12.

The central tubular portion 14 of the hub 12 is provided with a pair of diametrically opposed slots 100, 102 extending from the higher order end of the tubular portion to adjacent the drive gear 90. A pair of diametrically opposed radially extending reset and drive gear pawls 104, 105, preferably of sintered metal construction, are mounted in the opposed slots 100, 102 respectively and are pivotally mounted on the wheel hub 12 about parallel transversely extending axes by pivot pins 106, 108, respectively, for which purpose the hub is cast to provide a pair of transversely spaced pockets for each of the pivot pins 106, 108.

Figure 2:
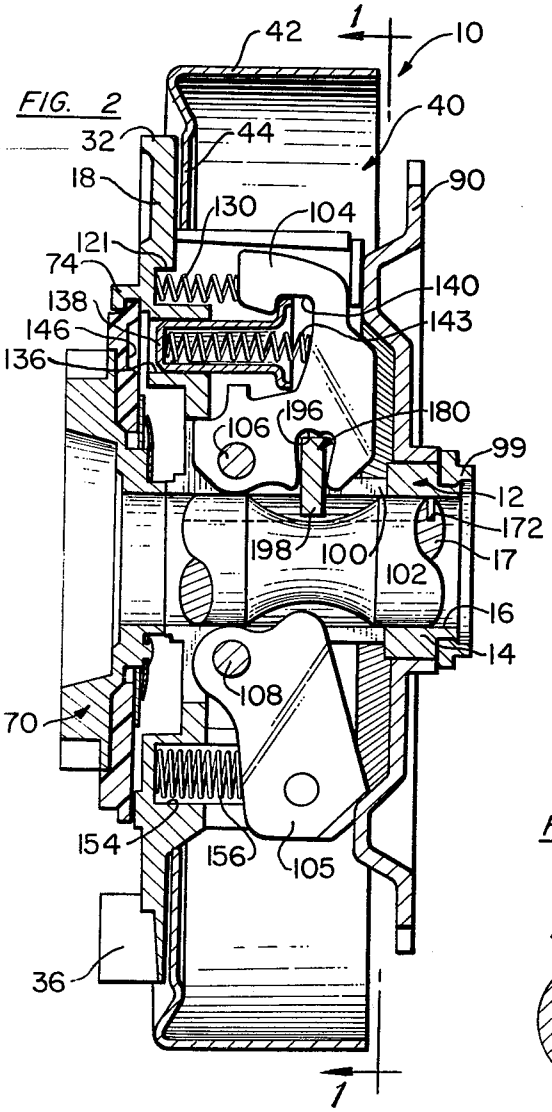
FIG. 2 is an axial section view, partly broken away and partly in section, showing the counter wheel assembly and its supporting shaft in their normal counting condition.

The hub flange 18 is formed to provide a radial slot 120 for receiving the reset gear pawl 104 and a generally cylindrical recess 121 for mounting a compression spring 130 that is operative to engage the reset gear pawl 104 to pivotally urge the pawl in the clockwise direction, as seen in FIG. 2. An axially extending opening 136 in the flange 18 forms a generally cylindrical recess for a sheet metal locking plunger 138. As best seen in FIG. 2, the plunger 138 is provided with a radial flange at its inner end which is received within a generally T-shaped slot 140 in the reset gear pawl 104. Accordingly, with the reset gear pawl 104 in its normal position shown in FIG. 2, maintained by the compression spring 130, the plunger 138 is in its retracted position clear of the reset gear 70, and upon pivotal actuation of the reset gear pawl 104, in the counterclockwise direction as seen in FIG. 2, the plunger 138 is urged axially under the force of a compression spring 143 into engagement with the reset gear 70. For receiving the plunger 138, the reset gear 70 is provided with a plurality of angularly spaced cylindrical recesses 146 that are adapted to receive the tapered end of the plunger 138 for securely connecting the reset gear to the indicia wheel for resetting the indicia wheel to zero with the reset gear as described in the aforementioned U.S. Pat. No. 2,932,448.

An axially extending generally cylindrical recess 154 is provided in the flange 18 for receiving a compression coil spring 156 adapted to urge the drive gear pawl 105, in the counterclockwise direction as seen in FIG. 2, into engagement with the drive gear 90 for securely connecting the indicia wheel for being rotated by the drive gear for counting.

In a well-known manner, the wheel support shaft 17 for the counter wheel assembly functions as a reset control shaft for disengaging the drive gear 90 and for engaging the reset gear 70 for resetting the wheel to zero. This is accomplished by axially shifting the reset shaft 17 for pivotally displacing the reset and drive gear pawls outwardly from the reset shaft. As seen in FIG. 2, the reset shaft 17 has an axially extending slot 172, which in the prior art wheel assembly of the type shown in U.S. Pat. No. 3,223,316, receives the reset gear pawl when the indicia wheel is located in its fully reset or zero position, whereupon the reset gear 70 is disengaged and the indicia wheel is locked to the reset shaft 17. If the indicia wheel is located in its zero position when the reset shaft 17 is axially shifted, the slot 172 receives the reset gear pawl and the reset gear is never engaged.

In accordance with the present invention, a second reset control pawl 180 is provided intermediate the reset gear pawl 104 and the wheel support shaft 17. The intermediate pawl 180 is pivotally mounted on the integral flange 18 of the hub 12 by means of an integral axially extending boss 184 of the hub 12 and whereby the intermediate pawl is pivotal about an axis parallel to but spaced substantially from the axis of the wheel support shaft 17. A reduced outer end 186 of the boss 184 is upset against a retaining washer 188 for retaining the intermediate pivotal pawl on the boss 184. Also, preferably the diameter of the boss 184 is made relatively large and the bearing gap is made relatively low so that the pawl is mounted to have negligible radial movement.

The pawl 180 has an outer inwardly projecting nose 190 received within the slot 100 of the wheel hub 12 and adapted to be received within the axially extending radial slot 172 of the wheel support shaft 17. For that purpose the axial slot 100 in the hub 12 is made wider than the conventional pawl slot (shown in U.S. Pat. No. 3,223,316) and the outer flat surface portion 192 of the central tubular portion 14 of the hub 12 is moved radially inwardly to provide suitable space for mounting the intermediate pawl 180 in position between the support shaft 17 and the reset gear pawl 104. Also, the reset gear pawl 104 is modified to form a radial slot 196 for receiving the intermediate pawl 180. The slot 196 is formed to permit the intermediate actuating pawl 180 to be pivoted outwardly by the wheel support shaft 17 (when the shaft 17 is axially shifted) for actuating the reset gear pawl 104, in the counterclockwise direction as viewed in FIG. 2, for locking the reset gear 70 to the indicia wheel.

The inwardly projecting nose 190 of the actuating pawl 180 has an inner end 198 with a width less than the constant width of the shaft slot 172, and whereby the pawl nose 190 is free to fall into the slot 172, under the bias of the reset gear pawl return spring 130, when it is rotated as the indicia wheel is reset, in alignment with the slot 172. Also, the pawl nose 190 is tapered inwardly toward its inner end 198, so that the nose width gradually increases radially outwardly from its inner end 198, and whereby the actuating pawl nose 190 is adapted to engage both sides of the shaft slot 172 when the pawl nose 190 is fully inserted in the slot 172 (and the reset gear 70 is disengaged). Accordingly, the actuating pawl 180 provides for locking the wheel assembly to the support shaft, when the actuating pawl nose 190 falls into the slot 172, to accurately hold the wheel at its zero position. Thus, upon reengagement of the wheel drive gear 90 and subsequent disengagement of the pawl 180 from the wheel support shaft 17 when the shaft is axially shifting to recondition the wheel for counting, the wheel is accurately angularly positioned at its zero readout at the start of a succeeding fuel delivery to ensure a continuing accurate gasoline delivery readout.

As indicated, the present invention is primarily applicable to the right hand or lowest order wheel of the cost and volume counters of a fuel pump register of the type described in U.S. Pat. No. 2,932,448. And it can be seen that the invention can readily be incorporated not only in the production of new wheels but also through the conversion of existing wheels (for example, during a periodic overhaul of the fuel pump register) merely by modifying or replacing the conventional reset gear pawl with the modified reset gear pawl 104, machining the hub 12 to form the enlarged slot 100 and the flat 192 and pivotally mounting the actuator pawl 180 on the wheel hub flange 18, for example with a pivot pin (not shown) threaded into a threaded opening formed in the flange 18.

As will be apparent to persons skilled in the art, various modifications, adaptations and variations of the foregoing specific disclosure can be made without departing from the teachings of the present invention.

I claim:

1. In a counter wheel assembly having an indicia wheel adapted for being rotatably supported on a reset control shaft, an independently rotatable reset gear coaxial with the indicia wheel, and a reset pawl mechanism with a reset gear pawl pivotally mounted on the indicia wheel for pivotal movement about an axis transverse to the axis of rotation of the indicia wheel for selective engagement and disengagement of the reset gear, the reset pawl mechanism having an inwardly extending projection selectively engageable by the reset control shaft for pivoting the reset gear pawl outwardly for engagement of the reset gear, the inwardly extending projection of the reset pawl mechanism being receivable in an axial slot in the reset shaft for locking the indicia wheel to the reset shaft in its fully reset position with the reset gear disengaged, the improvement wherein the reset pawl mechanism comprises a reset control pawl pivotally mounted on the indicia wheel about an axis parallel to and offset from the axis of rotation of the indicia wheel and having said inwardly extending projection selectively engageable by the reset shaft for selectively pivoting the reset control pawl outwardly, the reset control pawl being mounted for engaging and pivoting the reset gear pawl outwardly for engagement of the reset gear when the reset control pawl is pivoted outwardly by the reset shaft.

2. A counter wheel assembly according to claim 1 wherein the inwardly extending projection of the reset control pawl is tapered inwardly for receipt within and engaging both sides of the slot of the reset shaft for accurately locking the indicia wheel to the reset shaft in its fully reset position with the reset gear disengaged.

3. A counter wheel assembly according to claim 1 wherein the indicia wheel comprises a cast hub having a central axially extending tubular portion adapted for receiving the reset shaft and a radial flange portion, and a sheet metal indicia bearing rim secured to the radial flange portion, the reset gear being rotatably mounted at one axial end of the tubular portion, said tubular portion having an axially extending slot, the reset gear pawl being angularly aligned with said axially extending slot, and the reset control pawl being pivotally mounted on the cast hub flange to extend between the reset gear pawl and the reset control shaft and with its inward projection extending inwardly through said slot for engagement with the reset control shaft.

4. A method of improving the angular reset position accuracy of a counter wheel assembly of the type having an indicia wheel adapted for being rotatably supported on a reset control shaft, an independently rotatable reset gear coaxial with the indicia wheel, and a reset pawl mechanism with a reset gear pawl mounted on the indicia wheel for pivotal movement about an axis transverse to the axis of rotation of the indicia wheel for selective engagement and disengagement of the reset gear, the reset gear pawl having an inwardly extending projection selectively engageable by the reset control shaft for pivoting the reset gear pawl outwardly for engagement of the reset gear, the inwardly extending projection of the reset gear pawl being receivable in an axial slot in the reset control shaft for pivoting the reset gear pawl inwardly and locking the indicia wheel to the reset shaft with the indicia wheel in its angular reset position, the method comprising pivotally mounting a reset control pawl on the indicia wheel about an axis parallel to and offset from the axis of rotation of the indicia wheel and having an inwardly extending projection selectively engageable by the reset control shaft for pivoting the reset control pawl outwardly and receivable in the axial slot of the reset control shaft for pivoting the reset control pawl inwardly and locking the indicia wheel to the reset control shaft in its angular reset position, the reset control pawl being mounted to extend between the reset gear pawl and the reset control shaft, and employing a modified pivotal reset gear pawl which rests on the reset control pawl with the reset control pawl extending between the reset gear pawl and the reset control shaft, for pivoting the reset gear pawl outwardly and inwardly for engagement and disengagement respectively of the reset gear when the reset control pawl is pivoted outwardly by the reset control shaft and pivots inwardly into the axial slot of the reset control shaft.

* * * * *